US008083224B2

(12) United States Patent
Bridges et al.

(10) Patent No.: US 8,083,224 B2
(45) Date of Patent: Dec. 27, 2011

(54) TRAY ASSEMBLY FOR A PRINT PRODUCTION RESOURCE

(75) Inventors: Richard Thomas Calhoun Bridges, London (GB); Christopher Sharp, Hertfordshire (GB)

(73) Assignee: Xerox Corporation, Norwalk, CT (US)

( * ) Notice: Subject to any disclaimer, the term of this patent is extended or adjusted under 35 U.S.C. 154(b) by 99 days.

(21) Appl. No.: 12/428,012

(22) Filed: Apr. 22, 2009

(65) Prior Publication Data

US 2010/0270734 A1 Oct. 28, 2010

(51) Int. Cl.
*B65H 1/00* (2006.01)

(52) U.S. Cl. ..... 271/171; 271/145

(58) Field of Classification Search ..... 271/171, 271/145

See application file for complete search history.

(56) References Cited

U.S. PATENT DOCUMENTS 4,022,459 A * 5/1977 Mather ..... 271/223
4,358,102 A * 11/1982 Hoshizaki et al. ..... 271/164
5,328,167 A * 7/1994 Frank ..... 271/241
5,697,298 A * 12/1997 Greive et al. ..... 101/232
6,523,822 B1 * 2/2003 Galtier et al. ..... 271/171
7,540,484 B2 * 6/2009 Mandel et al. ..... 271/9.04
7,731,173 B2 * 6/2010 Maruyama et al. ..... 271/20

FOREIGN PATENT DOCUMENTS

JP 04023778 A * 1/1992
JP 05105243 A * 4/1993
JP 05319584 A * 12/1993

* cited by examiner

*Primary Examiner* — Michael McCullough
*Assistant Examiner* — Luis A Gonzalez
(74) *Attorney, Agent, or Firm* — Pepper Hamilton LLP

(57) ABSTRACT

A tray assembly for a print production resource may include a tray and a guide assembly. The guide assembly may include a first width guide configured to contact a first side of a media stack at a first location below a top sheet of the media stack such that a first distance exists between the top sheet and the first width guide. The guide assembly may include a second width guide configured to contact a second side of the media stack at a second location below the top sheet of the media stack such that a second distance exists between the top sheet of the media stack and the second width guide. The first side may be opposite the second side, and the tray assembly may be configured to be utilized with a top sheet feeder mechanism.

15 Claims, 5 Drawing Sheets

TRAY ASSEMBLY FOR A PRINT PRODUCTION RESOURCE

TECHNICAL FIELD

This invention relates to a tray assembly, and more particularly to a tray assembly for a print production resource.

BACKGROUND

It is common for multi-functional printing production resources to have adjustable trays that allow a single machine to feed a range of media sizes. These trays typically have specific guide positions to accommodate common media sizes. To ensure that customers can feed additional sizes of media within the minimum and maximum limits, the tray guide positions are usually adjustable.

To enable reliable feeding of media, however, a gap is usually required between the media stack and the width guides. If the gap is too large, the media can be fed with poor skew and registration, resulting in poor image to sheet orientation. If the gap is too small, or non-existent, the top sheet of the media stack can be pinched by the guides, which can result in difficulties in feeding the media sheets due to additional drag.

In addition, when a media stack is elevated, the load from the stack is commonly translated to a point on the main tray which causes the tray to deflect. This deflection can cause the side guides to bow inwards and further pinch the media stack, which in turn can cause mis-feeding of media sheets and device shut downs.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. As used herein, the term "comprising" means "including, but not limited to."

In an embodiment, a tray assembly for a print production resource may include a tray and a guide assembly. The guide assembly may include a first width guide configured to contact a first side of a media stack at a first location below a top sheet of the media stack such that a first distance exists between the top sheet and the first width guide. The guide assembly may include a second width guide configured to contact a second side of the media stack at a second location below the top sheet of the media stack such that a second distance exists between the top sheet of the media stack and the second width guide. The first side may be opposite the second side, and the tray assembly may be configured to be utilized with a top sheet feeder mechanism.

In an embodiment, a tray assembly may include a guide assembly. The guide assembly may include a first width guide configured to contact a first side of a media stack at a first location and a second width guide configured to contact a second side of the media stack at a second location. The first location and the second location may be below a top sheet of the media stack. At least one of the first width guide and the second width guide may not contact the top sheet. The first side may be opposite the second side. The tray assembly may be configured to be utilized with a top sheet feeder mechanism.

BRIEF DESCRIPTION OF THE DRAWINGS

Aspects, features, benefits and advantages of the present invention will be apparent with regard to the following description and accompanying drawings, of which.

DETAILED DESCRIPTION

Figure 1:
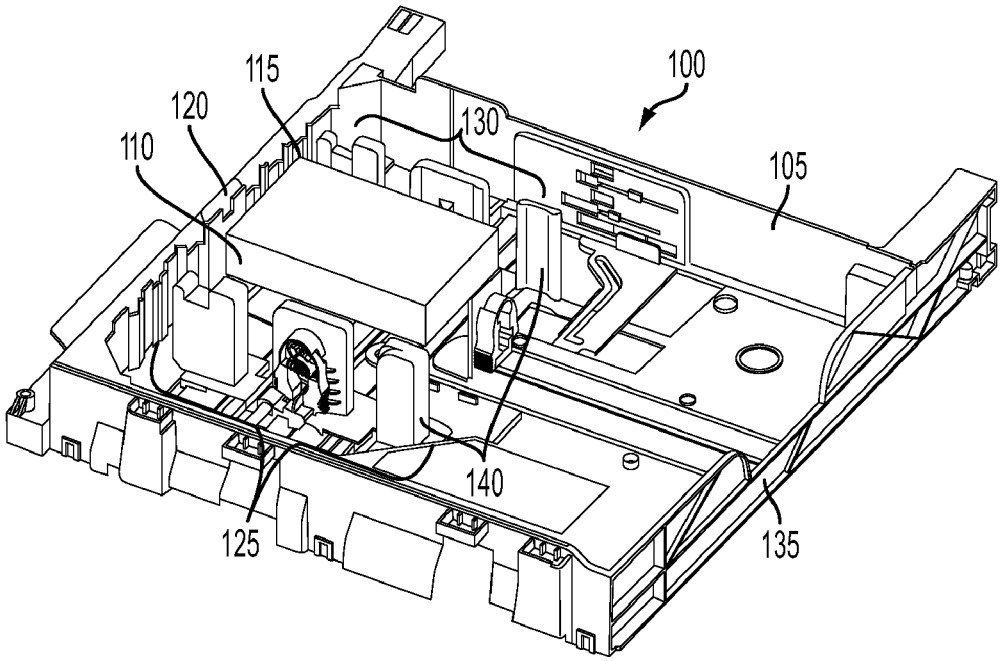
FIG. 1 illustrates an exemplary tray assembly according to an embodiment.

FIG. 1 illustrates an exemplary tray assembly 100 according to an embodiment. A tray assembly 100 may be a component of a print production resource. In an embodiment, the tray assembly 100 may be mounted in a slide-out drawer unit of a print production resource. For example, a slidable print tray may comprise a tray assembly 100 in a printer.

In an embodiment, a tray assembly 100 may include an elevate plate 110 and a guide assembly 140. In an embodiment, the tray assembly 100 may further include a tray 105. The elevate plate 110 may be located within the tray 105 as illustrated in FIG. 1. In an embodiment, the elevate plate 110 may be configured to support a media stack 115.

In an embodiment, the guide assembly 140 may include one or more guides. For example, the guide assembly may include a first width guide 125 and a second width guide 130. The media stack 115 may be retained on the elevate plate 110 between one or more guides. For example, the media stack 115 may be retained between a first width guide 125, which may be located on one side of the media stack, and a second width guide 130, which may be located on an opposite side of the media stack. In an embodiment, the elevate plate 110 may move vertically relative to the tray 105. In an embodiment, the elevate plate 110 may rotate about a pivot point in the tray 105.

In an embodiment, the tray assembly 100 is configured to be utilized with a feeding mechanism. For example, the tray assembly 100 is configured to be utilized with a top sheet feeder mechanism. A "top sheet feeder mechanism" as used herein, refers to a feeder that is configured to engage the top sheet of a media stack.

In an embodiment, the tray 105 may include a lead edge surface 120. The lead edge surface 120 may be a surface of the tray 105 that is located between a feeder and the elevate plate 110. In an embodiment, a media stack 115 may be registered against the lead edge surface 120 to position the sheets for feeding. Registering the media stack 115 to resource datums may facilitate the positive feeding of sheets and quality prints. For example, accurate stack registration may help minimize paper jams and/or damage to individual sheets. In addition, registration may assist in enhancing the quality of print and producing complete images that are centered on a sheet.

In an embodiment, the first width guide 125 may be positioned to the left of the media stack 115 relative to the front of the tray 135. A second width guide 130 may be positioned to the right of the media stack 115 relative to the front of the tray 135. In an embodiment, the width guides 125, 130 may be movably coupled to one another and may be adjusted to accommodate the media stack 115. For example, one or more of the width guides 125, 130 may be moved outwardly to allow placement of a media stack 115 between them. Similarly, one or more of the width guides 125, 130 may be moved inwardly to secure the media stack 115.

Figure 2:
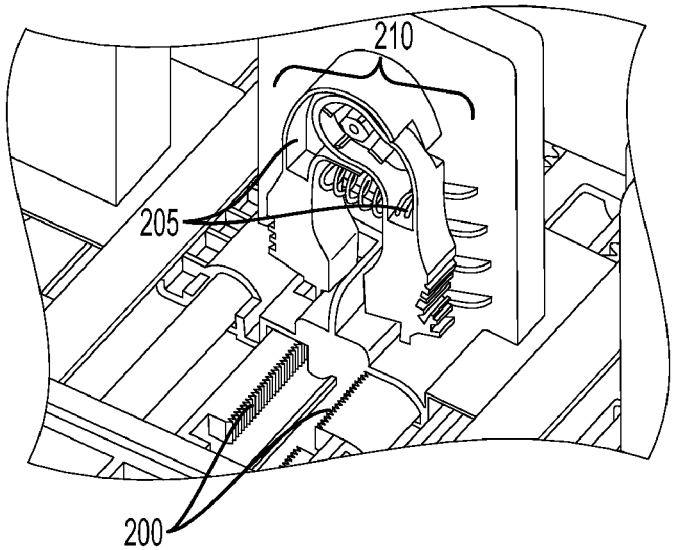
FIG. 2 illustrates an exemplary locking assembly for a tray assembly according to an embodiment.

In an embodiment, the tray 105 may include one or more tracks 200 as illustrated by FIG. 2. A track 200 may include one or more indents and/or one or more ratchets. In an embodiment, a track 200 may include linearly spaced indents and/or ratchets. In an embodiment, one or more teeth located on a bottom portion of one or more latches 205 of a locking mechanism 210 may engage an indent and/or a ratchet as illustrated by FIG. 2. A ratchet may include a linear series of teeth or other similar projections. In an embodiment, a projection of a ratchet may be spaced a distance away from an adjacent projection. For example, a projection may be located 1 millimeter away from an adjacent projection. In an embodiment, a ratchet may be molded into a tray. A ratchet may be fabricated from plastic, metal and/or any other suitable material.

In an embodiment, when positioned, the locking mechanism 210 may settle to the nearest whole tooth in a track 200. As such, the gap between the media stack 115 and the width guides 125, 130 positioning the stack may be between 0 millimeters and 2 millimeters for a locking mechanism having projections with a 1 millimeter spacing. Additional and/or alternate teeth, rack and gap configurations may be used within the scope of this disclosure.

Figure 3:
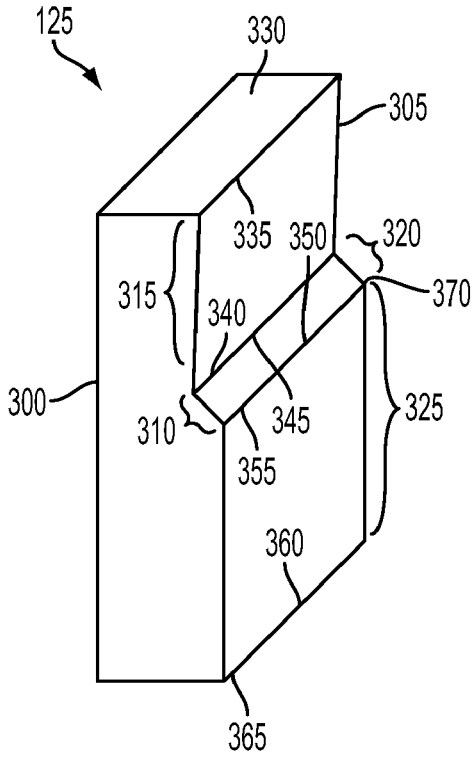
FIGS. 3 and 4 illustrate profiles of exemplary width guides according to an embodiment.

FIG. 3 illustrates a profile of an exemplary first width guide 125 according to an embodiment. As illustrated, a first width guide 125 may have a first side 300 and a second side 305. In an embodiment, the profile of the first side 300 may be substantially straight. In an embodiment, at least a portion of the profile of the second side 305 may be angled. For example, as illustrated by FIG. 3, a portion 310 of the second side 305 may be outwardly angled.

In an embodiment, the second side 305 of the first width guide 125 may include a first portion 315, a second portion 320 and a third portion 325. The first portion 315 may extend from the top 330 of the first width guide 125 to a point along the length of the second side 305. The first portion 315 may include a first end 335 and a second end 340.

In an embodiment, the second portion 320 may be angled outwardly relative to the first portion 315. The second portion 320 may include a first end 345 and a second end 350. In an embodiment, the first end 345 of the second portion 320 may be connected to the second end 340 of the first portion 315. For example, the first end 345 of the second portion 320 may be integrally formed with the second end 340 of the first portion 315.

In an embodiment, the third portion 325 may extend from the second portion 320 to the bottom 365 of the first width guide 125. The third portion 325 may include a first end 355 and a second end 360. In an embodiment, the second end 350 of the second portion 320 may be connected to the first end 355 of the third portion 325. For example, the second end 350 of the second portion 320 may be integrally formed with the first end 355 of the third portion 325. In an embodiment, the second end 350 of the second portion 320 and the first end 355 of the third portion 325 may define a ridge 370. The ridge 370 may extend across at least a portion of the length of the first width guide 125.

Figure 4:
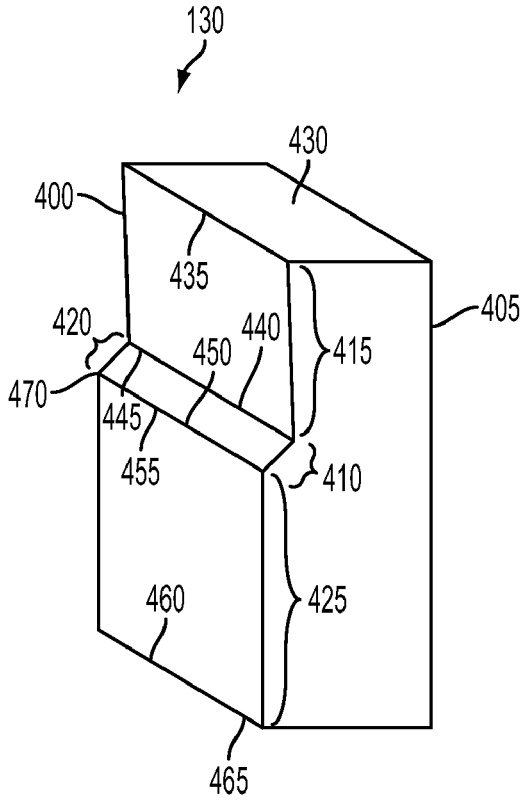

FIG. 4 illustrates a profile of an exemplary second width guide 130 according to an embodiment. As illustrated, a second width guide 130 may have a first side 400 and a second side 405. In an embodiment, at least a portion of the profile of the first side 400 may be angled. For example, as illustrated in FIG. 4, a portion 410 of the first side 400 may be outwardly angled. In an embodiment, the profile of the second side 405 may be substantially straight.

In an embodiment, the first side 400 of the second width guide 130 may include a first portion 415, a second portion 420 and a third portion 425. The first portion 415 may extend from the top 430 of the second width guide 130 to a point along the length of the first side 400. The first portion 415 may include a first end 435 and a second end 440.

In an embodiment, the second portion 420 may be angled outwardly relative to the first portion 415. The second portion 420 may include a first end 445 and a second end 450. In an embodiment, the first end 445 of the second portion 420 may be connected to the second end 440 of the first portion 415. For example, the first end 445 of the second portion 420 may be integrally formed with the second end 440 of the first portion 415.

In an embodiment, the third portion 425 may extend from the second portion 420 to the bottom 465 of the second width guide 130. The third portion 425 may include a first end 455 and a second end 460. In an embodiment, the second end 450 of the second portion 420 may be connected to the first end 455 of the third portion 425. For example, the second end 450 of the second portion 420 may be integrally formed with the first end 455 of the third portion 425. In an embodiment, the second end 450 of the second portion 420 and the first end 455 of the third portion 425 may define a ridge 470. The ridge 470 may extend across at least a portion of the length of the second width guide 130.

Figure 5:
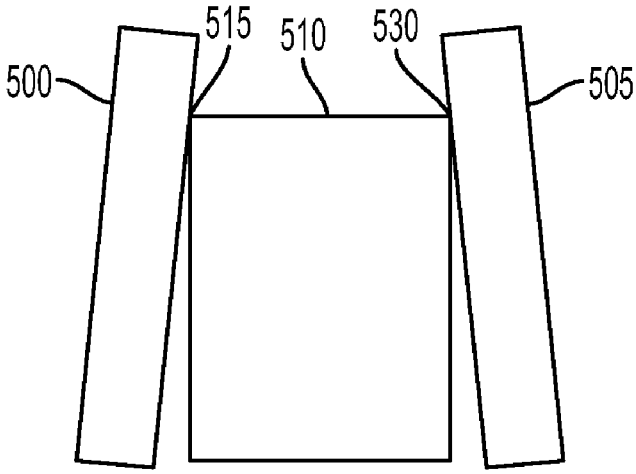
FIG. 5 (Prior Art)
FIG. 5 illustrates conventional width guides according to the known art.

FIG. 5 illustrates conventional width guides 500, 505 according to the known art. As illustrated by FIG. 5, the width guides 500, 505 may bow inwards due to tray deflections. When this occurs, the width guides 500, 505 may pinch the top sheet on either side 515, 530 of the media stack 510. This pinching may cause additional drag on the top sheet which may in turn cause difficulties feeding the top sheet from the media stack 510.

Figure 6:
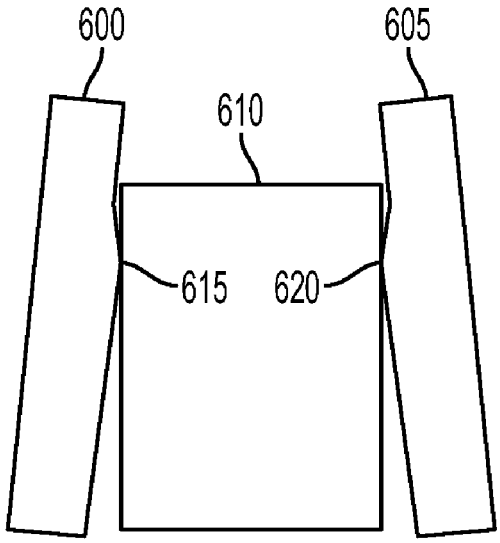
FIG. 6 illustrates exemplary width guides having angled profiles according to an embodiment.

FIG. 6 illustrates exemplary width guides 600, 605 having angled profiles according to an embodiment. As illustrated by FIG. 6, the width guides 600, 605 may bow inwards, however, due to their angled profiles, the width guides may pinch the media stack 610 at locations 615, 620 below the location of the top sheet of the media stack 610. In an embodiment, the ridges 370, 470 illustrated in FIG. 3 and FIG. 4 may contact the media stack 610. As such, a portion of the media stack 610 which is not currently being fed may experience the drag caused by the pinching rather than the top sheet.

As illustrated by FIG. 6, both width guides 600, 605 may pinch the media stack 610 at locations below the location of the top sheet, and a distance may exist between the media stack and both width guides. In an alternate embodiment, both width guides 600, 605 may pinch the media stack 610 at a location below the location of the top sheet, however, one width guide may contact the top sheet of the media stack. As such, a distance may only exist between the media stack and one width guide. For example, this may occur if the media stack 610 is not properly registered.

Figure 7:
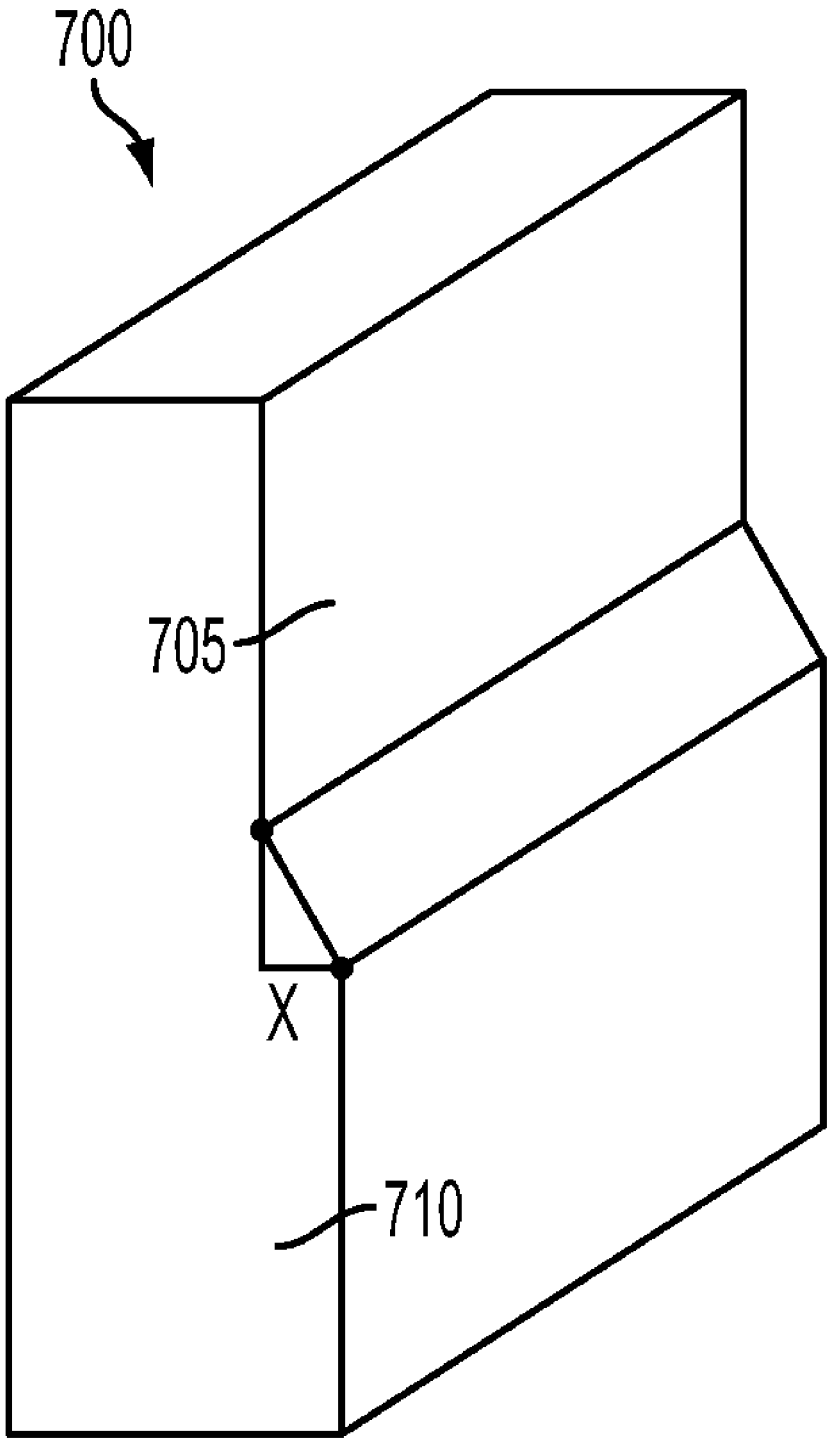
FIG. 7 illustrates an exemplary width guide according to an embodiment.

In an embodiment, when the width guides 600, 605 are pressed against a media stack 610, the gap between the base of the media stack and one or more of the width guides may be between a first value and a second value. In an embodiment, the first value may be the horizontal distance between the first portion and the third portion of a width guide and may be represented by 'x.' FIG. 7 illustrates an 'x' value for an exemplary first width guide according to an embodiment. As illustrated by FIG. 7, 'x' may represent the distance between the first portion 705 and the third portion 710 of the first width guide 700.

In an embodiment, the second value may be the sum of the first value and a distance between adjacent projections of a ratchet associated with the width guide. For example, for a ratchet having a distance of 1 millimeter between adjacent projections, the gap between the top sheet of the media stack and the width guide may be between 'x' and (1+x) millimeter.

In an embodiment, a distance between a top sheet of the media stack and the width guides may be reduced as the media stack is elevated and the width guides bow inwards. For example, as sheets are fed from the media stack and the stack is elevated, the width guides may bow inwards and the distance between the top sheet of the media stack and each width guide may decrease. As such, the gap between the top of the media stack and a width guide may be not be greater than the sum of the distance between the first portion and the third portion of the width guide and the distance between adjacent projections of a ratchet associated with the width guide. For example, for a ratchet having a distance of 1 millimeter between adjacent ratchet projections, the gap between the top sheet of the media stack and the width guide may not be greater than (1+x) millimeter.

In an embodiment, one or more factors may be considered when determining a value of 'x.' These factors may include the registration specification for the print production resource, the skew specification for the print production resource, the maximum guide to stack gap, the deflection of the guides from a full tray to an empty tray, the maximum drag allowable from the width guides and the available drive from a feeder mechanism that feeds the top media sheet from the media stack.

Figure 8A:
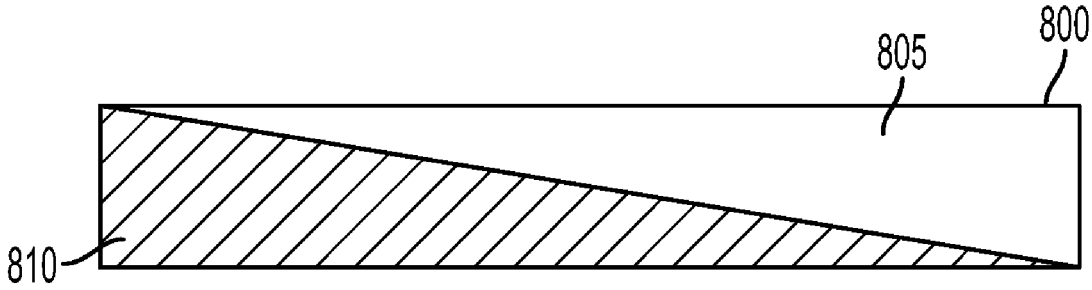
FIGS. 8A and 8B illustrate exemplary tray and width guides according to an embodiment.
Figure 8B:
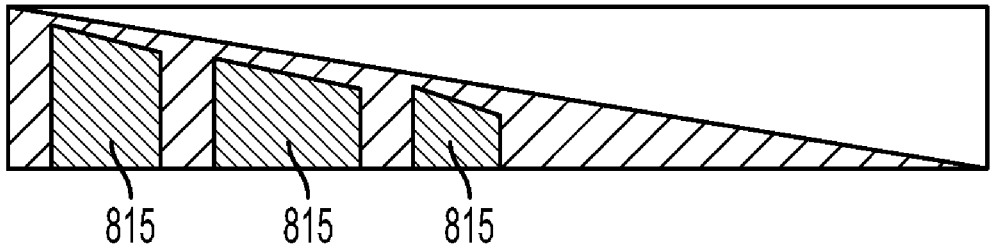

FIG. 8A illustrates an exemplary tray and width guide according to an embodiment. The un-hashed area 805 represents the area of a tray 800 from which sheets are fed from a media stack for a certain number of sheets in the stack. In contrast, sheets may not be fed from the hashed area 810 of the tray 800 for similarly sized stacks. To achieve the desired distance between the media stack and the width guides, only a portion of one or more width guides may have an angled profile. For example, the shaded area 815 in FIG. 8B may represent the area of a width guide that may have an angled profile. As illustrated by FIG. 8B, the area of a width guide having an angled profile 815 may be graduated across the length of the width guide.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A tray assembly for a print production resource, the tray assembly comprising:

a tray comprising a first track and a second track; and a guide assembly comprising:

a locking mechanism, a first width guide configured to contact a first side of a media stack at a first location below a top sheet of the media stack such that a first distance exists between the top sheet and the first width guide, wherein the first width guide comprises a first portion, a second portion and a third portion, wherein the first portion is substantially vertical, wherein the second portion is angled outwardly from the first portion, wherein the third portion is substantially vertical, wherein the second portion and third portion define a ridge, wherein an area of the second portion is graduated across a length of the first width guide, and a second width guide configured to contact a second side of the media stack at a second location below the top sheet of the media stack such that a second distance exists between the top sheet of the media stack and the second width guide, wherein the second width guide is associated with the second track, wherein the first width guide is located opposite the second width guide, wherein the locking mechanism is configured to secure the first width guide to the first track and to secure the second width guide to the second track.

2. The tray assembly of claim 1, wherein the first width guide is moveably connected to the second width guide.

3. The tray assembly of claim 1, wherein:

each of the first portion, the second portion and the third portion comprises a first end and a second end, the second end of the first portion is connected to the first end of the second portion, and the second end of the second portion is connected to the first end of the third portion.

4. The tray assembly of claim 1, wherein the ridge is configured to contact the media stack at the first location.

5. The tray assembly of claim 1, wherein the first distance is less than a value equal to a sum of a third distance between the first portion and the third portion of the second side of the first width guide and a fourth distance between adjacent projections of the first track that is associated with the first width guide.

6. The tray assembly of claim 1, wherein the area is located in a portion of the tray from which sheets of the media stack are not fed.

7. The tray assembly of claim 1, wherein the second width guide comprises:

a first side; and a second side, wherein the first side comprises:

a first portion, a second portion and a third portion, wherein the first portion is substantially vertical, wherein the second portion is angled outwardly from the first portion, wherein the third portion is substantially vertical, wherein the second portion and third portion define a ridge.

8. The tray assembly of claim 7, wherein:

each of the first portion, the second portion and the third portion comprises a first end and a second end, the second end of the first portion is connected to the first end of the second portion, and the second end of the second portion is connected to the first end of the third portion.

9. The tray assembly of claim 7, wherein the ridge is configured to contact the media stack at the second location.

10. The tray assembly of claim 7, wherein the second distance is less than a sum of a third distance between the first portion and the third portion of the first side of the second width guide and a fourth distance between adjacent projections of the second track ratchet that is associated with the second width guide.

11. The tray assembly of claim 7, wherein an area of the second portion is graduated across a length of the second width guide.

12. The tray assembly of claim 11, wherein the area is located in a portion of the tray from which sheets of the media stack are not fed.

13. The tray assembly of claim 11 further comprising: an elevate plate configured to support the media stack and move vertically relative to the tray to engage the top sheet of the media stack with the top sheet feeder mechanism.

14. A tray assembly comprising:

a guide assembly comprising:

a first width guide configured to contact a first side of a media stack at a first location;

a second width guide configured to contact a second side of the media stack at a second location, wherein the first location and the second location are below a top sheet of the media stack, wherein at least one of the first width guide and the second width guide does not contact the top sheet, wherein the first width guide is located opposite the second width guide; and a locking mechanism configured to secure the first width guide to a first track and to secure the second width guide to a second track, wherein the first width guide and the second width guide each comprise:

a first side comprising:

a first portion, a second portion and a third portion, wherein the first portion is substantially vertical, wherein the second portion is angled outwardly from the first portion, wherein the third portion is substantially vertical, wherein the second portion and third portion define a ridge, wherein a first distance between the top sheet and the first width guide is less than a sum of a second distance between the first portion and the third portion of the first side of the first width guide and a third distance between adjacent projections of the first track.

15. The tray assembly of claim 14, wherein a sum of a fourth distance between the top sheet and the second width guide is less than a sum of a fifth distance between the first portion and the third portion of the first side of the second width guide and a sixth distance between adjacent projections of the second track.

* * * * *